US006781810B1

(12) United States Patent
Jaehner et al.

(10) Patent No.: US 6,781,810 B1
(45) Date of Patent: Aug. 24, 2004

(54) REDUCED TENSIONING TIME FOR ELECTRONICALLY CONTROLLED SWITCH CONTACTORS

(75) Inventors: Wilfried Jaehner, Nürnberg (DE); Franz Ultsch, Erlangen (DE); Bernhard Streich, Amberg (DE); Diethard Runggaldier, Stegaurach (DE); Reinhard Maier, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/341,368

(22) PCT Filed: Jan. 7, 1998

(86) PCT No.: PCT/DE98/00035

§ 371 (c)(1),
(2), (4) Date: Oct. 5, 1999

(87) PCT Pub. No.: WO98/31034

PCT Pub. Date: Jul. 16, 1998

(30) Foreign Application Priority Data

Jan. 9, 1997 (DE) ..... 197 00 522

(51) Int. Cl.[7] ..... H01H 9/00
(52) U.S. Cl. ..... 361/160; 361/152
(58) Field of Search ..... 361/143, 152, 361/154, 160, 170, 187

(56) References Cited

U.S. PATENT DOCUMENTS

| | | | | | |
|---|---|---|---|---|---|
| 3,671,814 | A | * | 6/1972 | Dick | 361/154 |
| 4,429,342 | A | * | 1/1984 | Heider | 361/152 |
| 4,905,985 | A | * | 3/1990 | Nagatani | 271/277 |
| 5,784,244 | A | * | 7/1998 | Moran et al. | 361/154 |

FOREIGN PATENT DOCUMENTS

| | | | |
|---|---|---|---|
| DE | 30 47 488 | 7/1982 | H01H/47/32 |
| DE | 44 30 867 | 3/1996 | H01F/7/18 |
| EP | 0 376 493 | 7/1990 | H01H/47/04 |
| GB | 2 168 558 | 6/1986 | H03K/17/64 |
| WO | WO 96/12098 | 4/1996 | H01H/47/04 |

* cited by examiner

*Primary Examiner*—Ronald Leja
(74) *Attorney, Agent, or Firm*—Harness, Dickey & Pierce, P.L.C.

(57) ABSTRACT

Switchgear, in particular relays and/or contactors having a solenoid system with armature and yoke, a coil and an open- and/or closed-loop control device of the switchgear drive are described, wherein actual values of drive-specific parameters are detected by sensors.

After a switching command, the open- and/or closed-loop control device does not affect an output quantity (e.g., coil current) until at least one predefined threshold value of the switching parameters (for example, of contact speed) is attained.

2 Claims, 3 Drawing Sheets

REDUCED TENSIONING TIME FOR ELECTRONICALLY CONTROLLED SWITCH CONTACTORS

FIELD OF THE INVENTION

The present invention relates to switchgear, in particular relays and/or contactors with a solenoid system that includes an armature and a yoke, a coil and an open- or closed-loop controller of the switchgear drive, wherein actual values of drive-specific switching parameters are measured by sensors.

BACKGROUND INFORMATION

Switchgear having solenoid systems, for example, contactors, are used in drive and automation technology and serve, in conjunction with other components, for protecting and controlling electric loads.

In order to optimize such switchgear to their switching function, taking into consideration different operating conditions and specific equipment characteristics, the principle of controlled switching drives has been developed, which reduces the number of types of coils that were previously required due to their different excitation voltages. Such drives can be used for both AC and DC and, by reducing contact chatter, they reduce contact erosion and extend contact life. At the same time, the power consumption of the exciter circuit during the holding phase is reduced.

Thus, European Patent Application 376 493 describes a control circuit that allows for a high current during the closing operation of electromagnetic valves; this current is then reduced to a relatively holding current after the closing operation. German Patent No. 30 47 488 A1 describes, in addition to a coil current controller, an induction controller having a Hall probe arranged in the yoke. These control principles provide a higher coil current for the closing operation, which is reduced after the closing operation to a value that just provides for the force required for holding the armature in the closed position. German Patent No. 44 30 867 describes a switchgear drive control, which ensures that the optimum contact speeds and the limitation of the armature core impact speed are observed over the entire service life, taking into consideration interfering factors such as erosion and tolerances.

While efforts have de to achieve the aforementioned object using the correctional circuit arrangements for switchgear drives, either complex control algorithms have had to be used or concessions concerning the requirements of high closing speed of the contact with minimized chatter and low power consumption during the holding phase of the contactor have had to be made.

SUMMARY

An object of the present invention is to provide a simple and sturdy control algorithm of the switchgear drive resulting in high contact closing speed and minimum chatter of these contacts and low power consumption of the exciter circuit during the holding phase of the contactor.

This object is achieved according to the present invention by the fact that, after a switching command, the control device does not affect an output quantity, for example, coil current I, until at least one predefined threshold value of the switching parameters, for example, contact speed and/or this contact path and/or the flux is attained during a switching operation.

Thus it is achieved that the closing speed is very high, like in conventional contactor drives. After one or more limit values of specific switching parameters has been attained, such as time or contact path, the control device intervenes via flux or coil current I and thus minimizes chatter. In addition, power consumption by the exciter circuit during the holding phase of the contactor is thus reduced. These threshold values can be transmitted to the control device via sensors. Lag elements in the control circuit also result in delayed response of the control device.

DETAILED DESCRIPTION

Figure 1:
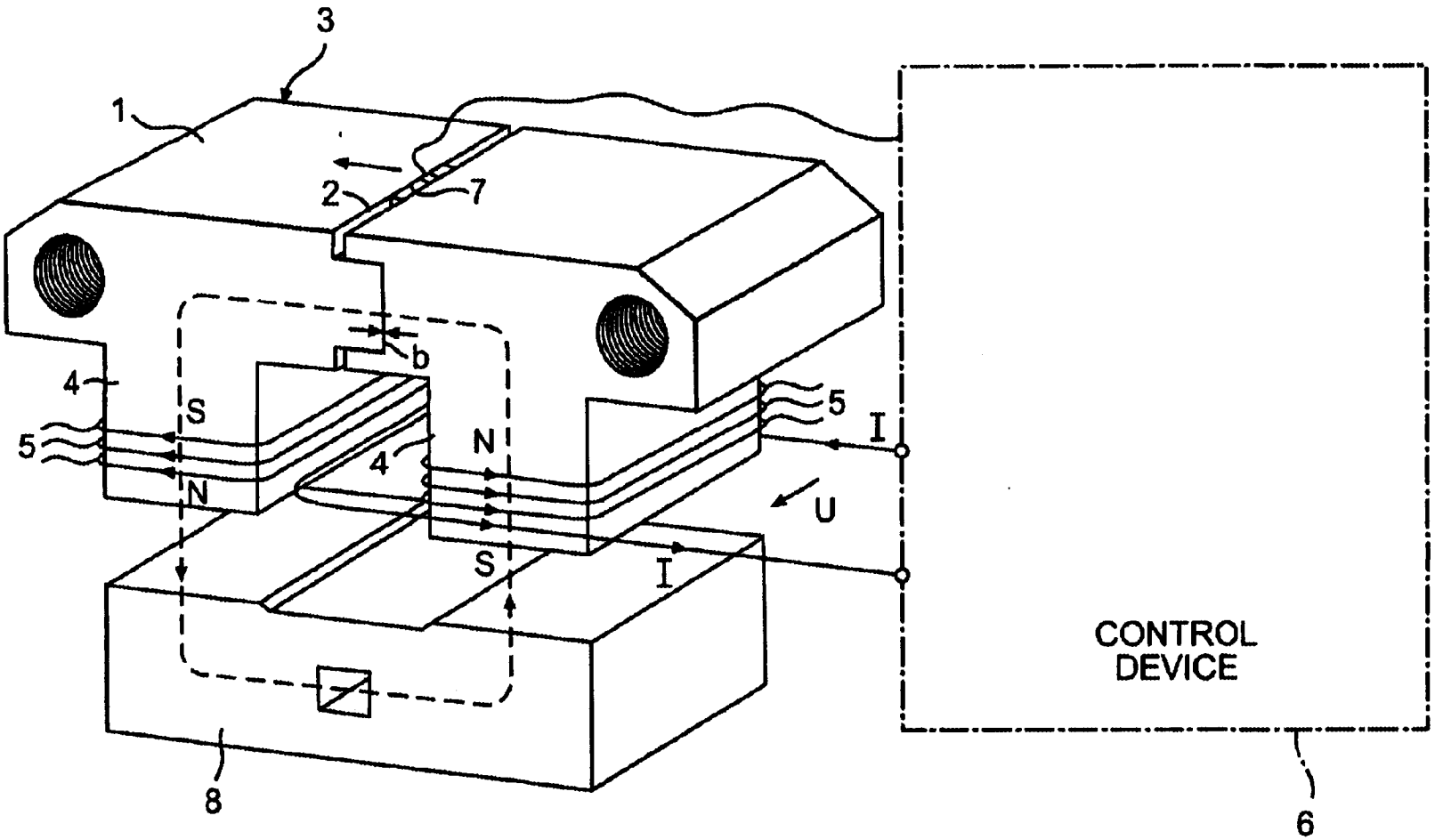
FIG. 1 shows a U core with fixed air gap, armature, coil and their control device.

FIG. 1 shows a yoke 1 designed as a U core 3 having a fixed by air gap 2. A schematically illustrated coil 5, activated via a control device 6, is located on each leg 4 of yoke 1. A flux sensor 7, which transmits the instantaneous flux data to control device 6, is arranged in fixed air gap 2.

Figure 2:
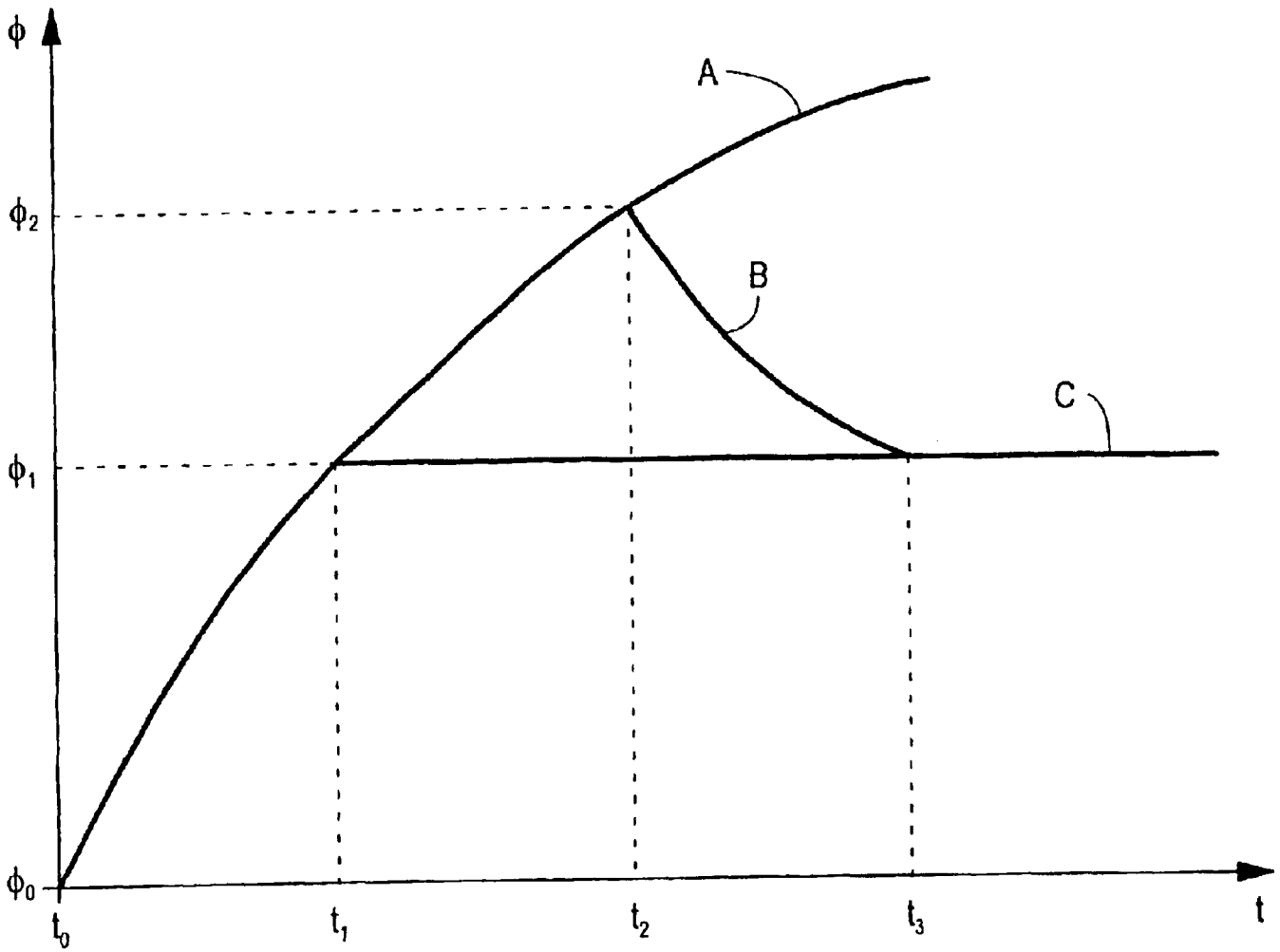
FIG. 2 shows a diagram where the magnetic flow Φ during the closing operation is plotted against time t for different control principles.

FIG. 2 shows the variation of magnetic flux Φ in fixed air gap 2 of magnet yoke 1 over time t for different control principles. In the case of uncontrolled variation of magnetic flux Φ, i.e., the entire control voltage U is always applied to coil 5, flux Φ has a variation A that is typical for the magnetic field, causing maximum acceleration of armature 8, which may then result in chatter on the fixed contact of the switchgear.

Curve C shows the variation of magnetic flux Φ when control device 6 intervenes immediately. Also in this case, the entire voltage U is-applied to coil 5 up to time $t_1$. As soon as the predefined flux Φ is attained, coil current I is controlled so that this value $\Phi_1$ of the flux is maintained virtually constant during the remaining time of the closing operation and during the holding phase of the contactor.

If control device 6 intervenes with a delay according to curve B, the entire control voltage U is again applied to coil 5, i.e., maximum acceleration initially occurs as in the case of unregulated contactor operation. After the elapse of a certain period of time $t_2$ after the switch-on command of the contactor to, control device 6 intervenes and, based on the value transmitted by flux sensor 7, reduces, by time $t_3$, coil current I and thus flux Φ to $\Phi_1$, which is sufficient for maintaining the contactor closed, while reducing chatter.

Figure 3:
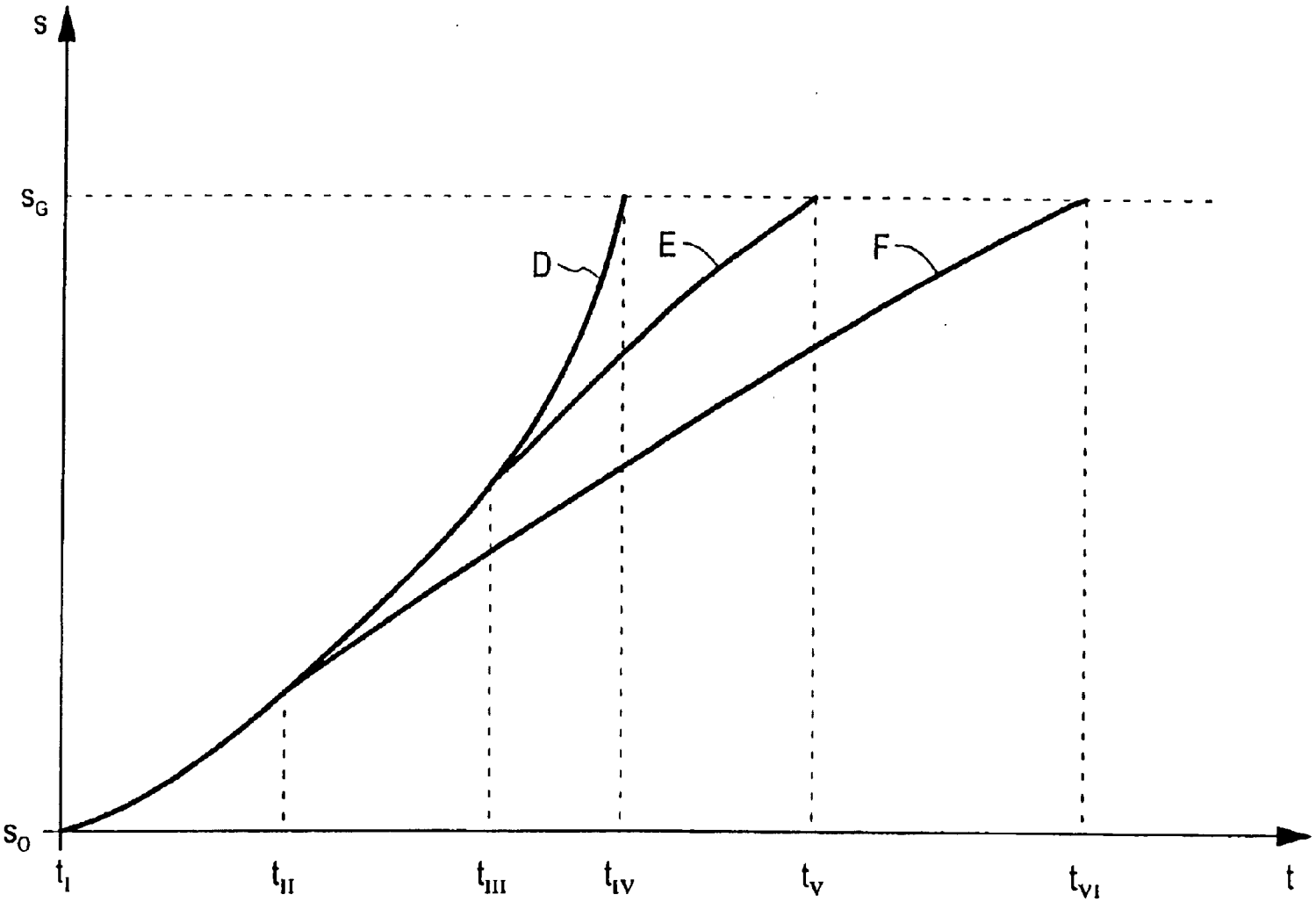
FIG. 3 shows a diagram where the armature path s during the closing operation is plotted against time t for different control principles.

FIG. 3 shows the variation of contact path s of a contactor over time t for different control principles, $s_o$ being the open switch position and $s_G$ being the closed switch position. In the case of unregulated contactor operation according to curve D, the contact closes fastest $t_{IV}$, since the full control voltage U is always applied to coil 5.

When the contactor drive is controlled immediately by control device 6 at time $t_{II}$ according to curve F, the longest switch-on times t occur, since, as in the case of curve C of FIG. 2, the entire control voltage U is only applied for a short period of time $t_I$, to $t_{II}$.

According to curve E of FIG. 3, the total switch-on time is reduced from $t_{VI}$ to $t_V$, i.e., by approximately 20% to 30% when control starts with a delay at time $t_{III}$.

As tests have shown, the relationships can be directly applied to solenoid systems whose yoke has an E-shaped design, for example.

What is claimed is:

1. A solenoid system for switchgear, comprising:

an armature;

a yoke;

a coil interacting with the yoke to move the armature;

sensors detecting actual values of drive-specific switching parameters; and a control device of a switchgear drive, the control device being one of an open-loop control device and a closed-loop control device, wherein after a switching command, the control device does not affect an output quantity for controlling the coil until a flux threshold value of the actual values of the drive-specific switching parameters is attained, the output quantity being a coil current, the drive-specific switching parameters being variable during a switching operation.

2. The solenoid system according to claim 1, wherein the flux threshold value is settable.

* * * * *